US007174913B2

(12) United States Patent
Albizuri

(10) Patent No.: US 7,174,913 B2
(45) Date of Patent: Feb. 13, 2007

(54) GAS TAP FOR A COOKING APPLIANCE, WITH A COVER FOR THE ROTARY SHAFT

(76) Inventor: Iñigo Albizuri, Calle Uno, No. 736 Z.I., 44940 Guadalajara Jalisco (MX)

( * ) Notice: Subject to any disclaimer, the term of this patent is extended or adjusted under 35 U.S.C. 154(b) by 212 days.

(21) Appl. No.: 10/953,247

(22) Filed: Sep. 28, 2004

(65) Prior Publication Data

US 2005/0284519 A1 Dec. 29, 2005

(30) Foreign Application Priority Data

Jun. 2, 2004 (ES) ..... 200401343 U

(51) Int. Cl.
*F16K 37/00* (2006.01)

(52) U.S. Cl. ..... 137/556; 251/288; 251/297

(58) Field of Classification Search ..... 251/286, 251/288, 297; 137/553, 556
See application file for complete search history.

(56) References Cited

U.S. PATENT DOCUMENTS 2,250,356 A * 7/1941 Brumbaugh ..... 251/96
3,443,591 A * 5/1969 Carlson ..... 137/625.3
3,751,003 A * 8/1973 Kass ..... 251/312
4,723,567 A * 2/1988 Phlipot et al. ..... 137/315.17
4,819,907 A * 4/1989 Gostelow ..... 251/96
5,836,333 A * 11/1998 Haynes ..... 137/1

* cited by examiner

*Primary Examiner*—A. Michael Chambers
(74) *Attorney, Agent, or Firm*—The Kline Law Firm

(57) ABSTRACT

The manual gas tap for a cooking appliance is of the type with a conical plug (3) for regulating the outlet gas flow (G), accommodated in a central housing (2*a*) in the tap body, and has a rotary actuating shaft (4) coupled to the conical regulating plug (3), and a tap cover (5) covering said central housing (2*a*). The rotary shaft (4) is provided with a transverse pin (6) for rotation thereof from an initial rotation locking position (7) corresponding to the gas supply "OFF", to two other spaced positions corresponding to the maximum and minimum gas flows. The tap cover (5) is a tubular bushing shaped and comprises a sealing base (5*c*) with a sliding surface (11) in the form of a circular arc segment (A) provided with a series of indentations (12), which are in friction contact with the transverse pin (6) and produce a tactile and/or acoustic indication of shaft (4) rotation and tap (1) opening.

4 Claims, 1 Drawing Sheet

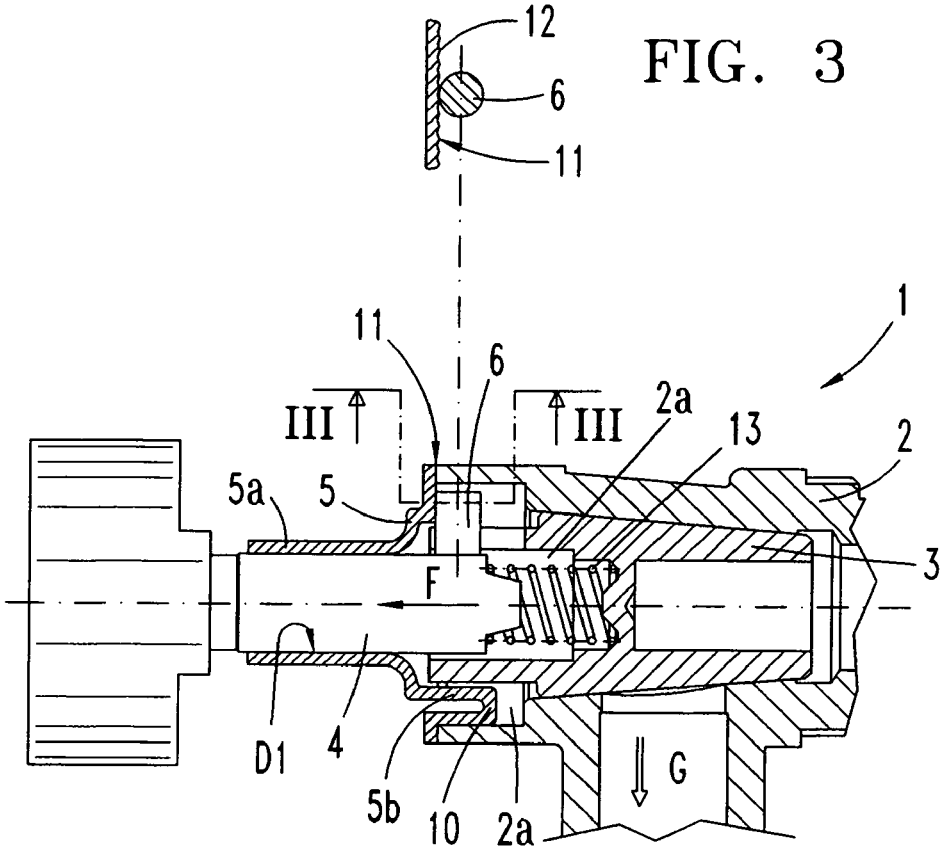
FIG. 3
FIG. 1
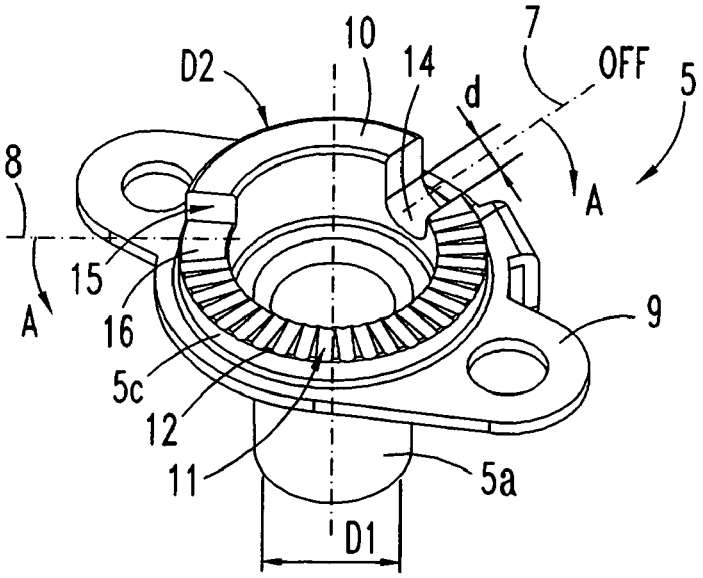
FIG. 2

GAS TAP FOR A COOKING APPLIANCE, WITH A COVER FOR THE ROTARY SHAFT

TECHNICAL FIELD

The present invention is related to a gas tap of the type with a regulating conical plug and a rotary actuating shaft, used on a gas cooking appliance and, in particular, to a constructional feature of a cover bushing for the shaft and the tap body.

PRIOR ART

Gas taps of the type defined above, provided with a tubular-shaped cover bushing with a tubular neck at the output end of the shaft guiding the latter's rotation and with a circular base that closes against an open surface on the tap body, are known.

In GB-A-2205849 a tap for a gas cooking appliance is disclosed whose rotary actuating shaft coupled to a conical regulating plug can turn through a given angle for the supply of a gas flow between two extreme angular positions corresponding to a maximum flow and a minimum flow, starting from an initial rotation locking position. The tap cover has the shape of a tubular bushing with a dome for guiding the shaft and a larger diameter tubular cover. The actuating shaft has a rotation lock pin extending in a radial direction on a circular transverse surface at the base of the cover, travelling through a given angle between two angular positions for the supply of a maximum flow and of a minimum flow from the regulating conical plug, starting from a rotation lock "OFF" position.

DISCLOSURE OF THE INVENTION

The object of the invention is a gas tap for a domestic cooking appliance of the type with a regulating rotary conical plug an a manual actuating shaft guided by a tubular shaped cover bushing, which is provided with means for allowing the shaft rotation between an angular locking position -OFF- and a rotation stop position -MIN- for the supply of the gas flow, giving an tactile and/or acoustic indication of the gas outlet opening.

For rotating the shaft a given angle between the two extreme positions, the rest position "OFF" and the minimum flow position, the shaft is provided with a transverse lock pin, and the tap cover is fitted with means for covering the actuating shaft and means for supporting and guiding the shaft in its rotation, and a circular base in the cover bushing provided with a sliding surface for said transverse lock pin. Upon actuating the tap shaft, the user perceives an acoustic indication produced by the transverse pin during its angular movement when frictions over said circular sliding surface, with the cooperation of a return spring urging on the shaft axially against the circular cover base.

It is a cost-saving advantage that the tap cover can be made by means of successive press-stamping only operations, with no additional machining, including the indentations or protuberances or notches with which the circular base of the cover is provided.

DESCRIPTION OF THE DRAWINGS

FIG. 1 is a partial sectional view of a gas tap for a cooking appliance, provided with an actuating shaft and a tap body cover.

FIG. 2 is a perspective view of the gas tap cover in FIG. 1.

FIG. 3 is a sectional view of a detail of FIG. 1 according to line III—III.

DETAILED DESCRIPTION OF AN EMBODIMENT OF THE INVENTION

With reference to FIGS. 1–3, an embodiment of gas tap 1 according to the invention comprises an elongated shaped tap body 2 with a central housing 2*a* to accommodate a regulating conical plug 3, a hand-operated rotary shaft 4 coupled to the conical plug 3, a return spring 13 for the shaft, and a tap cover 5 which covers said central housing 2*a* within the tap body, and in addition acts as a guide for the rotation. The shaft 4 may rotate an angle A in either of the two directions, normally more than 180 degrees, for the supply of a gas flow G, which is determined by the position of a transverse pin 6 on the shaft (FIG. 2), from an initial rotation locking position corresponding to gas supply "OFF", an intermediate position of maximum gas G flow, and a final position of minimum gas G flow supplied by the tap 1. The cover 5 takes the form of a tubular bushing and comprises a narrow tubular part 5*a* of diameter D1 encircling the outer free end of the shaft 4 snugly, and a cylindrical part 5*b* of a diameter substantially larger than D1, which is provided with a sealing base 5*c* with two fixing tabs 9 and a circular peripheral edge 10 of diameter D2 engaged in the body housing 2*a*.

The circular sealing base 5*c* on the cover bushing presents a circular sliding surface 11 extended over an arc corresponding to said angle of rotation A, on which the transverse pin 6 slides. The sliding surface 11 takes the form of an undercut surface in the direction of the axial length of the cover bushing 4 with respect to its circular edge 10, and presents a series of radial "indentations" intermittently against which the friction contact of pin 6 produces a tactile and/or acoustic indication for perception by the user. The transverse pin 6 is of diameter "d", big enough to move reciprocally in the axial direction by itself as it passes over each of the indentations 12, while it is pressed by an axial force F exerted by the return spring 13 on the shaft 4. In the embodiment of the cover 5 in the FIG. 2 a friction surface arc 11 of around 180 degrees is preferred.

The initial shaft rotation locking position 7 is determined by a "U"-shaped locking groove in the circular edge 10, adjacent to one arc end of the sliding surface 11. The groove 14 has an undercut depth in relation to the sliding surface 11 and a width the same as the diameter "d" of the pin 6 housed partly in it. For the pin 6 to disengage from the locking groove 14, the shaft 2 is pushed by the user towards the inside of the tap, overcoming the force F of the spring 13, and then maximum gas G flow is supplied by means of a rotation of the shaft.

To fix the rotational end position 8 corresponding to the minimum gas flow, the circular edge 10 presents a stop wall 15 for the rotation of the transverse pin, resting on a recess 16 at the end of the sliding surface 11. From the rest recess 16 the transverse pin 6 issues only by means of rotation in the opposite direction by mounting on the indented surface 12.

The tap cover 5 may be made by means of molding a light metal alloy, being then subjected to machining of the indentations 12 and the locking groove 14. For cost-saving purposes no further performing of machining operations is preferred after the molding of the cover 5. One preferred embodiment of the cover bushing 5 is made from a metal sheet by means of successive press-stamping operations. The sealing base 5*c* and the circular edge 10 with the axially oriented stop wall 15 are formed in this way, and also the frictional protrusions or indentations 12 on the sliding surface 11, and the adjacent locking groove 14.

What is claimed is:

1. A gas tap for a cooking appliance comprising:

an elongated tap body (2) with a conical plug (3) received in a central housing (2*a*) in the tap body to regulate a gas flow (G) outlet, a hand-operated rotary shaft (4) coupled to the conical plug, a cover bushing (5) covering said central housing, and a return spring (13) urging the shaft axially towards the cover bushing, wherein the actuating shaft is rotatable through an angle (A) in either of two directions, the shaft being provided with a radially oriented transverse pin (6), drawn by the shaft (4) from an initial rotation locking position (7) corresponding to the gas flow supply "OFF", to two spaced maximum and minimum gas flow shaft positions (8), said cover bushing (5) being tubular with a cylindrical part (5*b*) provided with a circular base (5*c*) sealing the tap body (2) and a peripheral edge (10) engaged in said central housing (2*a*), wherein said circular base (5*c*) in the cover includes a sliding surface (11) extended over an arc corresponding to said angle (A) of rotation of the shaft and provided with a series of indentations serving as a friction means (12) that are coextensive with shaft rotation angle (A) and that contact the radially oriented pin (6), said friction means producing an acoustic or tactile indication of the shaft (4) rotation while the tap (1) outlet is opening.

2. The gas tap according to claim 1, wherein the sliding surface (11) for the transverse pin takes the form of an undercut surface in the direction of the axial length of the cover bushing (4) with respect to its circular edge (10), and presents intermittently a series of indentations (12) against which the transverse pin (6) is engaged during the rotation of the shaft (4) in opposition to said return spring force (F).

3. The gas tap according to claim 1, wherein said circular edge (10) of the cover includes a groove (14) to accommodate the transverse pin (6) corresponding to the position (7) for locking shaft rotation (A), adjacent to an initial end of said sliding surface (11), and a rest recess (16) for the transverse pin corresponding to a second angular position (8) of shaft, with an axially extended stop wall included in said cylindrical part (5*b*) of the cover.

4. The gas tap according to claim 1, wherein the tap cover (4) is made by means of successive press-stamping operations starting from a thin metal sheet, including a tubular part (2*a*) extending from the free end of the shaft (4) to guide the shaft (4), said circular base (5*c*) and said sliding surface (11), provided with a series of protuberances or indentations (12) that provide frictional contact with the transverse pin (6).

* * * * *